US006266643B1

(12) United States Patent
Canfield et al.

(10) Patent No.: US 6,266,643 B1
(45) Date of Patent: Jul. 24, 2001

(54) SPEEDING UP AUDIO WITHOUT CHANGING PITCH BY COMPARING DOMINANT FREQUENCIES

(76) Inventors: Kenneth Canfield, 38 Sky Meadow Rd., Suffern, NY (US) 10901; Bruce deGraaf; Kathyrn deGraaf, both of 23 Edmunds Way, Northboro, MA (US) 01532-1457

( * ) Notice: Subject to any disclaimer, the term of this patent is extended or adjusted under 35 U.S.C. 154(b) by 0 days.

(21) Appl. No.: 09/261,496

(22) Filed: Mar. 3, 1999

(51) Int. Cl.[7] ..... G10L 21/04
(52) U.S. Cl. ..... 704/278; 704/258; 704/504
(58) Field of Search ..... 704/258, 269, 704/278, 504

(56) References Cited

U.S. PATENT DOCUMENTS

| | | | | |
|---|---|---|---|---|
| 3,816,664 | | 6/1974 | Koch | 179/15.55 T |
| 5,073,938 | | 12/1991 | Galand | 381/34 |
| 5,189,702 | * | 2/1993 | Sakurai et al. | 704/266 |
| 5,216,744 | * | 6/1993 | Alleyne et al. | 704/200 |
| 5,535,300 | | 7/1996 | Hall, II et al. | 395/2.36 |
| 5,694,521 | * | 12/1997 | Shlomot et al. | 704/262 |
| 5,717,818 | | 2/1998 | Nejime et al. | 395/2.2 |
| 5,717,823 | * | 2/1998 | Kleijn | 704/220 |
| 5,799,270 | | 8/1998 | Hasegawa | 704/205 |
| 5,819,212 | | 10/1998 | Matsumoto et al. | 704/219 |
| 5,832,437 | | 11/1998 | Nishiguchi et al. | 704/268 |
| 6,098,046 | * | 8/2000 | Cooper et al. | 704/503 |

OTHER PUBLICATIONS

Pan Jianping, "Effective Time–Domain Method for Speech Rate–Change," IEEE Trans. on Consumer Electronics, vol. 34, No. 2, p. 339–346, May 1988.*

"4.5.3 Protection Against False DTMF Signals." http://support.dialogic.com/releases/dos/voicebrick /vfg/VFG–76.htm. Aug. 1998.

Cochran, William T. et al. "What is the fast Fourier transform?." *IEEE Trans. on Audio and Electroacoustics.* Jun. 1967: 45–55.

Bergland, G. D. "A guided tour of the fast Fourier transform." *IEEE Spectrum.* Jul. 1969: 41–52.

Hsu, Hwei P. *Applied Fourier Analysis.* Orlando, Florida: Harcourt Brace Jovanovich, 1984.

Transnational College of LEX. *Who is Fourier? A Mathematical Adventure.* Boston, MA: Language Research Foundation, 1997.

Zonst, Anders E. *Understanding the FFT.* Titusville, Florida: Citrus Press, 1995, PPS 160–167.

Zonst, Anders E. *Understanding FFT Applications.* Titusville, Florida: Citrus Press, 1997, pp. 2–3, 16–17, 20–23, 32–33, 88–89, 94–99, 112–131.

* cited by examiner

*Primary Examiner*—Tālivaldis Ivars Šmits
(74) *Attorney, Agent, or Firm*—Tom Hamill, National Patent Services

(57) ABSTRACT

A fast and economical method for speeding up an audio signal without changing pitch can be accomplished by eliminating unneeded information from an audio signal. First, the signal is divided into chunks (frames or subframes), on which a mathematical manipulation such as a Fourier transformation is performed to identify the amplitudes of the componenet sinusoids (sines and cosines). These absolute values of the sine and cosine amplitudes for each frequency are averaged together, and the highest value (s) represents the signature, or dominant frequency/frequencies. The dominant frequency/frequencies or signatures from one chunk are compared to those of the next, and when identical the latter unit is marked as redundant. The final step consists of discarding redundant chunks from the original data, thus providing a shortened signal for replay. The pitch will not change because the only modification to the original signal was the elimination of redundant data.

29 Claims, 1 Drawing Sheet

SPEEDING UP AUDIO WITHOUT CHANGING PITCH BY COMPARING DOMINANT FREQUENCIES

FIELD OF INVENTION

Figure 1:
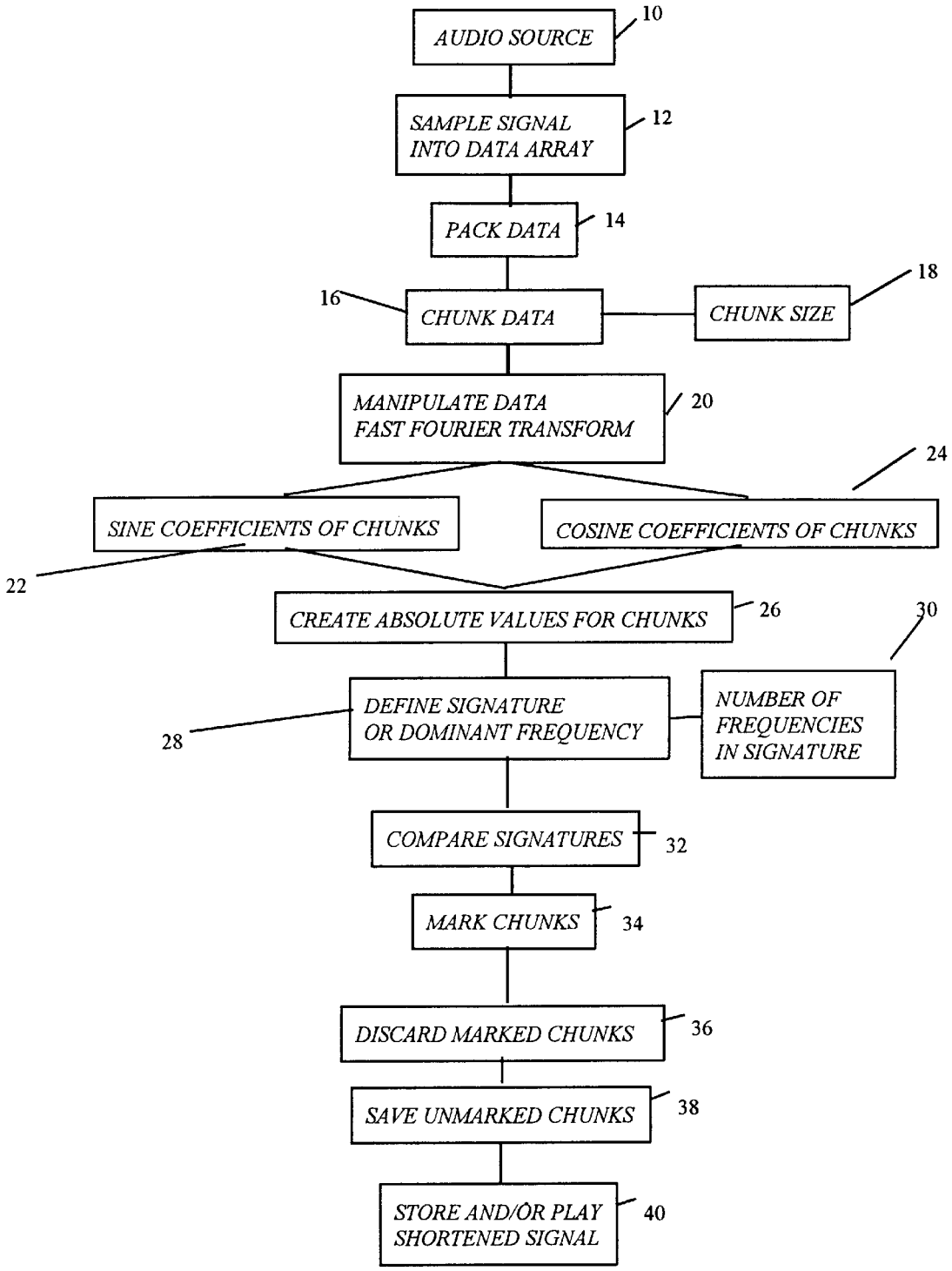

This invention relates to audio and speech processing, more particularly, to speeding up the audio signal or speech without changing pitch, while maintaining acceptable quality and minimizing processing time.

This invention will demonstrate how designing a computer program that uses a fast Fourier transform can accomplish the goal of pitch stabilization, i.e., speed up wave audio files (extension: wav) without changing the pitch.

BACKGROUND OF THE INVENTION

Speeding up audio or speech generally results in change of pitch and decreased quality. Previous inventions were complex in their methods to protect the integrity of the original information.

When the playback speed of audio increases, the pitch increases respectively. According to the Similarity Theorem, decreased time (increased playback rate) results in higher frequencies which translates to higher pitch (Zonst 1995). This phenomenon is illustrated when a 33⅓ RPM record is played at 78 RPM. Not only is the resulting sound difficult to understand, but the speaker also is unidentifiable, sounding like a chipmunk.

An alternative method to achieve this goal is to remove data at a fixed sampling rate, whether the data is redundant (duplicate) or original. Other methods use more complex and process time consuming methods by performing an inverse mathematical manipulation such as an inverse Fourier transform to recreate the shortened information. A variety of encoding methods are used for transmitting audio signals that are not easily manipulated for speeding up the original signal. Simpler approaches which just eliminate periods of silence do not produce a quality result.

In general, while these other inventions examine various aspects of the objective of this invention, they have not provided a satisfactory conclusion of the combination of simplicity and quality.

OBJECTS OF THE INVENTION

It is the principal object of this invention to create a fast and low cost method to speed up an audio signal without changing pitch while maintaining integrity for the understanding of the information.

Another objective for this invention to operate with minimal processing requirements for the computer or other device that will be performing the required data manipulations.

Another objective for this invention is to provide sufficient final audio quality without the complications extreme processing requirements of other methods.

SUMMARY OF THE INVENTION

The trigonometric Fourier series, f(t) in Eq.1, can express any physically realizable function to a desired degree of accuracy by the summation of sinusoids (sine and cosine waves) of various frequencies and a constant term. In Eq. 1, "n" counts the frequencies. The fundamental, one cycle in the waveform domain, is represented by n=1. Successive values of n represent the respective harmonics. For example, n=3 represents the third harmonic, which corresponds to three cycles of the sinusoid in the waveform domain. (Hsu 1984; Zonst 1995)

Fourier Analysis

Fourier Series $$f(t) = a_0 + \sum_{n=1}^{\infty} (a_n \cos(n\omega_0 t) + b_n \sin(n\omega_0 t)) \quad \text{Eq. 1}$$

where $\omega_0 = 2\pi/T = 2\pi f$

In Eq. 1 the limit of summation of the frequencies is infinity, an impossibility in a "real life" system.

The traditional representation of a function is the time domain. Time is the independent variable, and amplitude is the dependent variable. The frequency domain is another way to represent the same function. Because of the Fourier series, any physically realizable function can be represented as a series of sinusoids. In the frequency domain, frequency (represented by "n" in Eq. 1) is the independent variable, and the corresponding amplitude (represented by "$a_n$" or "$b_n$" in Eq. 1) is the dependent variable. These amplitudes are also known as Fourier coefficients. (Zonst 1995). Most sound analysis, including this invention, is performed in the frequency domain. A Fourier transform is a mathematical device to convert between the time and frequency domains. The discrete Fourier transform, also known as the digital Fourier transform, or the DFT, is used to determine the Fourier coefficients for the data points of "digitized" data. Digitized data is a series of discrete data points, instead of a continuous curve of an infinite number of points. In "real-life" applications, discrete data and a finite number of frequencies must be used, because real-life situations must deal with finite quantities. (Bergland 1969)

Eq. 2 is an example of a DFT used to determine the Fourier coefficients for cosine. To find the coefficient of the cosine of frequency f, first multiply and sum each discrete value of the function by a unit cosine wave of that frequency. Then find the average value, the desired information, by dividing the summed value by the number of data points, N.

$$DFT\mathrm{Cos}(f) = 1/N \sum_{t=0}^{N-1} f(t)\mathrm{Cos}(ft) \quad \text{Eq. 2}$$

where f=discrete frequency

N=number of discrete data points t=discrete times

DFTCos(f)=amplitude of the cosine wave of frequency f

To find the sin values, replace cosine with sine above equation

The problem with the DFT is its slow execution. An array of N points, $N=2^n$, requires $N^2$ complex operations to perform a DFT. A "complex operation" includes evaluating sine and cosine functions, multiplying by the data point, and adding these products to the sums of the other operations. However, an FFT requires only N×n operations. For example, for an array size of 1,024 points (n=10) representing under one tenth of a second of audio, a DFT would require 1,048,576 complex operations, while an FFT would require only 10,240 complex operations. The difference in execution time between an FFT and a DFT is further magnified when full-length audio is used. (Zonst 1995)

In addition, the FFT reduces round-off errors, meaning it is more accurate than the DFT. (Cochran et al. 1967)

According to the addition theorem, the Fourier transform of the sum of two functions is equal to the sum of the Fourier transforms of the two functions (Zonst 1995)

According to the shifting theorem, " . . . if a time domain function is shifted in time, the amplitude of the frequency components will remain constant, but the phases of the components will shift linearly—proportional to both the frequency of the component and the amount of the time shift." The shift at the Nyquist frequency will always be 180° ($\pi$ radians) multiplied by the number of data points the time domain function was shifted. (Zonst 1995)

"Stretching," a method of expanding digitized data, is accomplished by placing zeros in between the data points in the time domain, thereby repeating the spectrum of the original function in the frequency domain, with the amplitudes (coefficients) of the frequency components halved. (Zonst 1995)

A DFT on an 8 point array would need 64 complex operations. However, if the 8 point array were split into two 4 point arrays, each 4 point DFT would need only 16 complex operations. Thus, the total number of operations for the two 4 point DFTs would be 32—half the number of the full 8 point DFT. This "divide and conquer" process is the key to the FFT. (Zonst 1995; Transnational College of LEX 1997)

The theory behind the FFT algorithm rests on the addition, shifting, and stretching theorems. The proof begins with the following 8 point array:

$$|\text{DATA ARRAY 0}|=|D0, D1, D2, D3, D4, D5, D6, D7| \quad \text{Eq.3}$$

The addition theorem allows Eq. 3 to be divided into two arrays without changing the transform:

$$|\text{DATA ARRAY 1'}|=|D0, 0, D2, 0, D4, 0, D6, 0| \quad \text{Eq. 4}$$

$$|\text{DATA ARRAY 2'}|=|0, D1, 0, D3, 0, D5, 0, D7| \quad \text{Eq. 5}$$

where $$|\text{DATA ARRAY 0}|=|\text{DATA ARRAY 1'}|+|\text{DATA ARRAY 2'}| \quad \text{Eq. 6}$$

In this case each array would require 64 operations to perform a DFT, thus doubling the number of operations. Yet, this situation must be examined further. With the Stretching Theorem, the transform of a stretched array is the same as the transform of the unstretched array, except that it is repeated. The fact that the amplitudes are halved can be ignored during this discussion, because the amplitudes will still be present in the same ratios. (Zonst 1995)

$$X\text{form } |\text{DATA ARRAY 1'}|=|F0, F2, F4, F6, F0, F2, F4, F6| \quad \text{Eq. 7}$$

As expected, the transform of the four data points is repeated. But, if the zeros are removed from the array, the same components will result, but only once.

$$|\text{DATA ARRAY 1}|=|D0, D2, D4, D6| \quad \text{Eq. 8}$$

$$X\text{form } |\text{DATA ARRAY 1}|=|F0, F2, F4, F6| \quad \text{Eq. 9}$$

In the same fashion:

$$|\text{DATA ARRAY 2}|=|D1, D3, D5, D7| \quad \text{Eq. 10}$$

$$X\text{form } |\text{DATA ARRAY 2}|=|F1, F3, F5, F7| \quad \text{Eq. 11}$$

After the transforms in equations 9 and 11 are obtained the transforms of |DATA ARRAY 1'| and |DATA ARRAY 2'| are combined. The transform of |DATA ARRAY 1'| is obtained by stretching, or repeating the transform of |DATA ARRAY 1|. However, to get from the transform of |DATA ARRAY 2| back to the transform of |DATA ARRAY 2'|, the transform of the former must be stretched and then shifted. The stretching is accomplished as with the transform of |DATA ARRAY 1|—the spectrum must be repeated. The shifting is accomplished by the frequency equivalent of a one point data shift in the time domain, phase shifts ranging from zero (at the zero frequency component) to $\pi$ (at the Nyquist frequency). Mathematically, each component must be shifted by $2\pi f/N$ radians, where f=frequency and N=total number of frequencies. The two transforms can then be summed together to form the transform of the original function. (Zonst 1995)

Using the same 8 point array, the two 4 point arrays can be split into four 2 point arrays. These in turn can be split into eight 1 point "arrays." The one point DFT is special; only one frequency component exists, and the transform is equal to itself. Thus, there is no real DFT to be performed. Instead, the FFT only shifts and adds.

The above discussion of the FFT states that the original array is divided by two until a one point array is reached. Thus, the original array must be a power of two. However, when a sound is recorded, its size cannot be controlled. Thus, the array must be extended to the nearest power of two by "packing" it with zeros. "Packing" was a term used by the inventor to explain the process of filling the empty array spaces with zeros. This term was first used by Robert Blackwell in 1965.

When working with audio, a "sample" is a reading of the amplitude of the sound wave. According to the Nyquist rule, the sampling rate, the number of samples taken per second, must be at least twice the highest frequency, known as the Nyquist frequency. If this 2:1 ratio is abandoned, a phenomenon termed "aliasing" will occur, meaning that all frequencies above the Nyquist frequency are folded back into the spectrum, yielding incorrect values. In other words, the data from the frequencies above the Nyquist frequency interfere with the data from the frequencies at or below the Nyquist frequency. For example, for sixteen data points the Nyquist frequency is eight. If frequencies above eight are present, aliasing will occur. The solution is to filter off frequencies above the Nyquist frequency. (Zonst 1995; Zonst 1997)

The program developed to illustrate this invention uses a sampling rate of 11,025 Hertz. This value may be set in a software such as the Multimedia setup in the Control Panel in Microsoft's Windows 95 or 98. ("Hertz," or "Hz," is the unit for "per second," in this case samples per second.) Thus, the Nyquist frequency of 5512 Hz is more than sufficient, as the typical frequencies of human voice range from 300 Hz to 3000 Hz (http://support.dialogic.com/releases/dos/voicebrick/vfg/VFG-76.htm). Additionally, no filtering is required, as there are no major frequency components above the Nyquist frequency.

To illustrate this invention a program is created using Microsoft Visual Basic 5 Service Release 3 and a personal computer with an Intel Pentium II processor to speed up audio without changing the pitch. However, rather than speeding up the entire sound, and making the speech faster by a certain increment, an original approach not previously discussed or attempted was designed to eliminate periods of silence and repeated sounds. For example, "Thisssss<pause> is aaaa<pause> tesssst" is shortened to "This is a test." Thus, the speed-up is not equal throughout the sound.

After the sound is acquired, it is placed in an array, and "packed" with zeros to the next power of two. The data must then be divided into "chunks" (frames or subframes). To comply with the requirements for the FFT, the chunk must be of the size $2^n$. An FFT was performed against each data chunk to find the coefficients of the frequencies. Next, the absolute values of the coefficients of the cosine and sine of the same frequency were averaged together, to form one value for each frequency. The frequency/frequencies with the highest coefficients are found for each chunk, hereafter to be known as the "signature" of the chunk. This researcher's program compared each chunk with the next chunk. If two successive chunks had the same signature, the second was marked. The original data was then copied to form the output, with the marked chunks ignored. In effect, the second chunk was eliminated. An inverse FFT was never performed. Instead, the FFT was used to ascertain what should be eliminated, and then the original data was adjusted accordingly.

Code 1 located in the Appendix of this document, is the FFT algorithm used in this researcher's program. The FFT routine first declares variables and prepares the program form for the FFT. It then takes readings of the sound wave at 11,025 Hz and stores the samples in "SoundData( )," a process written by this researcher. It then calls "PackData" (Code 2 located in the Appendix of this document), a routine developed by this researcher to "pack" SoundData( ) with zeros up to the next power of 2, because the FET only works on powers of two. The FFT then continues to set up variables and arrays to be used during computation. The FFT loop begins at the comment "Outer loop of FFT."

The outer loop counts the data chunks, and controls the FFT so that an FFT is performed on each chunk. The "DataStart" variable is initialized at the beginning and represents the location of the first data sample of the chunk in SoundData( ). The data for one chunk is then copied from SoundData into "c(0,x)." The two working arrays in the FFT are "c(x,x)" and "s(x,x)." (The x's are used to make it clear that these are two-dimensional arrays.) These arrays hold only the data for one chunk at a time, unlike SoundData( ) which holds the data for every chunk The FFT algorithm begins with the stage loop which counts the partial DFTs. The "Universal Butterfly" (labeled on Code 1) performs the shifting and summing process of the FFT. This is the main part of the FFT, and is carried out in three "For . . . Next" loops: the "freq" loop and the two "data" loops. The FFT is completed and the data is copied from the working arrays into the output arrays, which are fcos(x,x) and fsin(x,x). These arrays, like SoundData( ) hold the data from all chunks at once. The difference is that SoundData( ) is in the time domain and fcos(x,x) and fsin(x,x) are in the frequency domain. This process is then performed on the next chunk.

Code 3 located in the Appendix of this Document, the "Compress" routine, is the main routine for speeding up the sound. The "Compress" routine is the heart of the program, as it controls the routines that analyzes the sound, and then speeds up the sound without changing the pitch. It is called after the FFT has been performed on the entire sound. The first action is the calling of the "Loudest" routine (Code 4 located in the Appendix of this document), to find the signature for each chunk. After calling Loudest, it compares the signatures of successive chunks, and marks a "True" in the boolean array (killchunk( )) if the chunk should be gotten rid of, and a "False" if the chunk should be kept. Next, it calls the "SquishCopy" routine (Code 5 located in the Appendix of this document) which uses "killchunk( )" to copy the needed chunks. Lastly, it calls "WaveSave" to save the new sound to a temporary file. If the user of the program chooses to do so, he or she may later save the sound to a permanent file. The code for the "WaveSave" routine is not included because it is not part of this researcher's speed up process.

The "Loudest" routine finds the signature of each chunk. First, it averages together the absolute values of the sine and cosine of each frequency to obtain one positive value for each frequency. These amplitude values are stored in the "val( )" array. The corresponding frequency numbers are stored in the "ix( )" array. Next, the Loudest routine finds the frequency with the highest amplitude and stores the corresponding frequency number in the "fsig( )" array. It then sets the amplitude of the highest frequency to "−1," so it is not picked up again when searching for the next highest frequency. The procedure repeats the process of finding the frequency with highest amplitude NumSig times. NumSig stands for the number of frequencies in the signature. One would represent the loudest frequency only; two would be the two loudest; etc. During the experimentation process the user tested various values for NumSig.

"Loudest" does not check the zeroth frequency, stored in val(0), because this is the constant term. Representing a shift in amplitude of the entire time domain wave form, and having a direct relationship with the volume of the entire wave, not a specific frequency, this value will often be higher than all other frequencies. Had Loudest stored this value in the signature, it would be possible that all the chunks would have the same signature, and the entire sound would be eliminated.

Code 5 located in the Appendix of this document, shows the "SquishCopy" routine, which copies only the needed chunks of the old data. The data is copied from "SoundData( )" back into "SoundData( )." "OldIndex" represents the location of the first data point of the chunk to be copied, and "NewIndex" represents the target location of the first data point. "OldIndex" increases each time through the loop. "NewIndex" only increases when a copy is made; it stays the same for boolean values of true, insuring that the data is copied to the correct location. Although the data is copied to and from the same array, the needed data is never over written. This is because NewIndex will always be lower or equal to OldIndex. Thus, this researcher's program looks at all of the old data before overwriting. At the end, SoundLength is set to be the length of the new sound, so that when the Compress procedure calls the WaveSave procedure, the correct data is saved.

BRIEF DESCRIPTION OF THE FLOW CHART

FIG. 1 is a functional block diagram of the preferred embodiment.

DESCRIPTION OF THE PREFERRED EMBODIMENTS

FIG. 1 illustrates the preferred method of the present invention. When working with audio, a "sample" is a reading of the amplitude of the sound wave. According to the Nyquist rule, the sampling rate or the number of samples taken per second, must be at least twice the highest frequency, also known as the Nyquist frequency. Therefore, the audio source 10 uses a sampling rate of 11,025 Hertz. The Nyquist frequency of 5512 Hertz is more than sufficient, as the typical frequencies of human voice range from 300 Hertz to 3000 Hertz. No additional filtering is employed since there are no major frequency components above the Nyquist frequency.

For illustrating the capabilities of this invention, a program was created using Microsoft Visual Basic 5 Service Release 3 on a personal computer with an Intel Pentium II processor. After the sound is acquired, it is placed into an array or wave table, 12, and "packed" 14 with zeros to the next power of two. The data must then be divided into "chunks (frames or subframes)," 16. To comply with the requirements for the fast Fourier transform (FFT) used, the chunk size 18, must be of the size $2^n$. The chunk size is a variable input. As chunk size decreases, the length of sound will decrease, as smaller chunk sizes lead to higher compression. Smaller chunk sizes represent less time, thereby increasing the chance for consecutive identical signatures or dominant frequencies. Although each chunk eliminated would save less time as the chunk size gets smaller, this is counteracted by the larger number of chunks being eliminated. Sound quality will diminish as chunk size decreases.

An FFT, 20, is performed on each data chunk to find the sine, 22, and cosine coefficients, 24, of the frequencies. The absolute values of the sine and cosine coefficients of the same frequency are averaged together, to form one value for each frequency within the each chunk, 26. The frequency/frequencies with the highest values are found for each chunk and are defined hereinafter as the signature or dominant frequency/frequencies, 28. The terminology of dominant frequency or dominant frequencies or signature or signatures may be considered interchangeable for the purposes of this document and claims. The number of frequencies in the signature is a variable that can be input into the process, 30. However, a change in the number of frequencies in the signature proves to have no effect on the length of the sound, meaning the most dominant frequency is the important one.

A comparison is made between the signatures of one chunk to the next, 32. If two successive chunks have the same signature, the second chunk in the original wave table is marked, 34. The original data can then be copied or stored, 38, without the marked chunks, 36. The shortened signal, 40, can now be played or stored.

An inverse FFT was never performed. Instead, the FFT was used to ascertain what should be eliminated, and then the original data was advised accordingly.

APPENDIX

FFT: Code 1

```
Public Sub ZonstFFT(ChunkSize As Integer)
Dim TimerStart As Single, TimerDuration As Single
' For Chunk routine
Dim DataStart, Chunk,i,ii
Dim FreqStart, iiFreq ' Inverse FFT
' Zonst's FFT variables
Dim k, k9, j1, kt, k1, inouttemp
Dim stage ' counts stages of computation
Dim DFTSize ' Size of partial DFT
Dim SkipIndex ' Skip index for twiddle factors
Dim freq ' count frequencies
Dim data ' count data
' Optimize FFT
Dim tempc As Single, temps As Single
Dim tempkc As Single, tempks As Single
Dim fcostemp As Single, fsintemp As Single
Dim DataPlusFreq, J1PlusData
TimerStart = Timer
' Prepare frmMain for FFT
frmMain.ctlMM.Command = "Close"
frmMain.txtStatus.Caption = " "
frmMain.cmdFFT.Enabled = False
' Save sound into SoundData
SoundLength = WaveIOLoad(App.Path + "\temp.wav",
    SoundData(1), SoundSIZE)
PackData
' The FFT
FFTNow:
```

APPENDIX-continued

```
DataStart = 0
NumChunks = SoundLength / ChunkSize
HalfChunkSize = ChunkSize / 2
PackPower = Log(ChunkSize) / Log(2#) '(ChunkSize = 2 ^ PackPower)
' Redim arrays to correct size based on ChunkSize
ReDim c(1, ChunkSize - 1) As Single
ReDim s(1, ChunkSize - 1) As Single
ReDim kc(ChunkSize - 1) As Single
ReDim ks(ChunkSize - 1) AS Single
ReDim fcos(NumChunks - 1, ChunkSize - 1) As Single '(chunk,freq)
ReDim fsin(NumChunks - 1, ChunkSize - 1) As Single '(chunk,freq)
' Get cosine values into KC( ) and sine values KS( )
    k1 = 2 * PI / ChunkSize
    For i = 0 To ChunkSize - 1
        kc(i) = Cos(k1 * i)
        ks(i) = Sin(k1 * i)
    Next i
' Outer loop of FFT
For Chunk = 0 To NumChunks - 1
    DataStart = Chunk * ChunkSize
    ' Copy data for single chunk
    ' Copy SoundData into c(0,x), the array used by the FFT
    For i = 0 To ChunkSize - 1
        c(0, i) = SoundData(i + DataStart)
        c(1, i) = 0
        s(0, i) = 0
        s(1, i) = 0
    Next i
    ' Set Zonst's FFT array toggle things for foward FFT
    inout0 = 1
    inout1 = 0
    For stage = 0 To PackPower - 1
        DFTSize = 2 ^ stage
        SkipIndex = 2 ^ (PackPower - stage - 1)
        ' "Universal" Butterfly
        For freq = 0 To ((HalfChunkSize) - 1) Step DFTSize
            j1 = 2 * freq
            k9 = freq + HalfChunkSize
            For data = 0 To DFTSize - 1
                kt = data * SkipIndex
                k = k9 + data
                tempc = c(inout1, k)
                temps = s(inout1, k)
                tempkc = kc(kt)
                tempks = ks(kt)
                DataPlusFreq = data + freq
                J1PlusData = j1 + data
                c(inout0, J1PlusData) = (c(inout1, DataPlusFreq) +
                    tempc * tempkc - temps * tempks) * 0.5
                s(inout0, J1PlusData) = (s(inout1, DataPlusFreq) +
                    tempc * tempks + temps * tempkc) * 0.5
            Next data
            j1 = j1 + DFTSize
            For data = 0 To DFTSize - 1
                kt = (data + DFTSize) * SkipIndex
                k = k9 + data
                tempc = c(inout1, k)
                temps = s(inout1, k)
                tempkc = kc(kt)
                tempks = ks(kt)
                DataPlusFreq = data + freq
                J1PlusData = j1 + data
                c(inout0, J1PlusData) = (c(inout1, DataPlusFreq) +
                    tempc * tempkc - temps * tempks) * 0.5
                s(inout0, J1PlusData) = (s(inout1, DataPlusFreq) +
                    tempc * tempks + temps * tempkc) * 0.5
            Next data
        Next freq
    ' Swap values of inout0 and inout1
    inouttemp = inout0
    inout0 = inout1
    inout1 = inouttemp
    Next stage
    For i = 0 To ChunkSize - 1
        fcos(Chunk, i) = c(inout1, i)
        fsin(Chunk, i) = s(inout1, i)
    Next i
frmMain.prgBar.Value = 100 * Chunk / NumChunks
Next Chunk
```

APPENDIX-continued

```
frmMain.cmdFFT.Enabled = True
frmMain.ctlMM.Command = "Open"
TimerDuration = Timer - TimerStart
' Let user know FFT is done by printing to txtStatus.caption
frmMain.txtStatus.Caption = "FFT Accomplished!" + CR +
    Str(TimerDuration)
End Sub
```

PACKDATA: Code 2

```
Public Sub PackData( )
' Make SoundLength = 2 ^ N
    For PackPower = 0 To 20
        If SoundLength <= 2 ^ PackPower Then
            PackLength = 2 ^ PackPower
            GoTo PackDataNow
        End If
    Next PackPower
PackDataNow:
' Pack SoundData with zeros until next power of 2
    For PackIt = SoundLength To PackLength - 1
        SoundData(PackIt) = 0
    Next PackIt
    SoundLength = PackLength
End Sub
```

COMPRESS: Code 3

```
Public Sub Compress(ChunkSize As Integer, NumSigs As Integer)
ReDim killchunk(NumChunks - 1)
ReDim fsig(NumChunks - 1, NumSigs - 1)
At this point the data is ready for the FFT.
Dim i As Integer, ii As Integer
For i = 0 To NumChunks - 1
    Call Loudest(i, ChunkSize, NumSigs)
    killchunk(i) = False
Next i
For i = 0 To NumChunks - 2
    For ii = 0 To NumSigs - 1
        If fsig(i, ii) <> fsig(i + 1, ii) Then GoTo nexti
    Next ii
    killchunk(i + 1) = True
nexti:
Next i
Call SquishCopy(ChunkSize)
Call WaveSave
End Sub
```

LOUDEST: Code 4

```
Public Sub Loudest(ChunkIndex As Integer, NumFreqs As Integer,
    NumSigs As Integer)
Dim i As Integer, ii As Integer
Dim Swapped As Boolean
Dim first As Integer
Dim tempval As Single, tempix As Integer
Dim val( ) As Single
ReDim val(NumFreqs - 1)
Dim ix( ) As Integer
ReDim ix(NumFreqs - 1)
For i = 0 To NumFreqs - 1
    val(i) = (Abs(fcos(ChunkIndex, i)) + Abs(fsin(ChunkIndex, i))) * 0.5
    ix(i) = i
Next i
tempix = 1
tempval = val(1)
For i = 0 To NumSigs - 1
    For ii = 2 To NumFreqs - 1
        If val(ii) > tempval Then
            tempval = val(ii)
            tempix = ii
        End If
    Next ii
    fsig(ChunkIndex, i) = tempix
    val(tempix) = -I#
Next i
End Sub
```

SQUISHCOPY: Code 5

```
Public Sub SquishCopy(ChunkSize)
Dim OldIndex As Long, NewIndex As Long
Dim NumOldChunk, NumofKills, NumNewChunk, data
NumofKills = 0
NumNewChunk = 0
For NumOldChunk = 0 To NumChunks - 1
    If killchunk(NumOldChunk) = False Then
        OldIndex = NumOldChunk * ChunkSize
        NewIndex = NumNewChunk * ChunkSize
        For data = 0 To ChunkSize - 1
            SoundData(NewIndex + data) = _
                SoundData(OldIndex + data)
        Next data
        NumNewChunk = NumNewChunk + 1
    End If
Next NumOldChunk
SoundLength = NewIndex + ChunkSize
End Sub
```

What is claimed is:

1. A method for eliminating superfluous information from an audio signal using a Fourier transform permitting the audio signal to be speeded up without a subsequent change in pitch, the method including the steps:

A) separating the audio signal into a series of chunks (frames or subframes),

B) performing a Fourier transformation on each one of said chunks, revealing sine and cosine Fourier coefficients for each of a large number of frequencies in each one of said chunks, C) averaging the absolute values of the sine and the cosine Fourier coefficients for each one of a large number of frequencies in each one of said chunks, determining the occurrence of one or more of the highest averaged absolute value(s) of sine and cosine Fourier coefficients for said large number of frequencies within one or more of said chunks, said highest averaged absolute value(s) to be called the dominant frequency(ies) or "signature", D) comparing each one of said dominant frequency(ies) in each one of said chunks with each one of said dominant frequency(ies) of the next one of said chunks in said series, marking each chunk with said dominant frequency(ies) substantially identical to the said dominant frequency(ies) of the previous chunk in said series, E) removing said marked chunk(s) from said series of chunks, providing a shortened signal, and F) saving the remaining data of unmarked information for replay, whereby, when said audio signal is played, the duration of the signal is lessened without a consequent change in pitch.

2. The method according to claim 1, wherein the Fourier transform is a fast Fourier transform.

3. The method according to claim 1, wherein the Fourier transform is a discrete Fourier transform.

4. The method according to claim 1, where, in place of steps (B) and (C), a transform, equation, or mathematical process other than a Fourier transform capable of determining the signature is employed.

5. The method according to claim 1, wherein there is a fixed selection or a variable selection of discrete unit or chunk sizes.

6. The method according to claim 1, wherein there is a fixed selection or a variable selection of the number of dominant frequencies, that is, the number of frequencies in the signature.

7. The method according to claim 1 wherein said comparing step is performed on a subsequent one of said dominant frequencies, if more than one dominant frequency is used.

8. The method of claim 1 wherein said audio signal which is to be shortened is read into a data array by a sampling or digitizing process.

9. The method of claim 8 wherein said data array is packed or extended with zeros the next power of 2.

10. The method of claim 8 wherein said data array is chosen to be a length equal to that of the length of said audio signal.

11. A computer readable medium with a computer program written in Visual Basic or another computer language, that decreases the time of the audio signal with no subsequent change in pitch by implementing the method in claim 1.

12. Hardware, such as chips or electrical circuits, that decreases the time of the audio signal with no subsequent change in pitch by implementing the method in claim 1.

13. A method for eliminating superfluous information from an audio signal using a Fourier transform permitting the audio signal to be speeded up without change in pitch, the method including the steps:

A) separating the audio signal into a series of chunks (frames or subframes),

B) performing a Fourier transformation on each one of said chunks, revealing sine and cosine Fourier coefficients for each of a large number of frequencies in each one of said chunks, C) averaging the absolute values of the sine and the cosine Fourier coefficients for each one of a large number of frequencies in each one of said chunks, determining the occurrence of one or more of the highest averaged absolute value(s) of sine and cosine Fourier coefficients for said large number of frequencies within one or more of said chunks, said highest averaged absolute value(s) to be called the dominant frequency(ies) or "signature", D) comparing each one of said dominant frequency(ies) in each one of said chunks with each one of said dominant frequency(ies) of the next one of said chunks in said series, and additionally comparing each one of said dominant frequency(ies) in each one of said chunks with each one of said dominant frequencies of subsequent chunks in said series, marking each chunk with said dominant frequency(ies) substantially identical to the said dominant frequency(ies) of a previous chunk in said series, E) removing said marked chunk(s) from said series of chunks, providing a shortened signal, and F) saving the remaining data of unmarked information for replay, whereby, when said audio signal is played, the duration of the signal is lessened without a consequent change in pitch.

14. The method according to claim 13, wherein the Fourier transform is a fast Fourier transform.

15. The method according to claim 13, wherein the Fourier transform is a discrete Fourier transform.

16. The method according to claim 13, where, in place of steps (B) and (C), a transform, equation, or mathematical process other than a Fourier transform capable of determining the signature is employed.

17. The method according to claim 13, wherein there is a fixed selection or a variable selection of said chunk sizes.

18. The method according to claim 13, wherein there is a fixed selection or a variable selection of the number of dominant frequencies, that is, the number of frequencies in the signature.

19. The method according to claim 13 wherein said comparing step is performed on a subsequent one of said dominant frequencies, if more than one dominant frequency is used.

20. The method according to claim 13, wherein said substantially identical audio data which includes the last of said chunks in said series, or a last number of said chunks of a queue of three or more identical said chunks which have been marked, then said audio data is stored without the said substantially identical data.

21. The method according to claim 13, wherein said substantially identical data which consists of said last chunk, or the last number of said chunks of a queue of three or more identical one of said chunks are removed from said series.

22. The method of claim 13, wherein said audio signal is read into a data array by a sampling or digitizing process.

23. The method of claim 22 wherein said data array is packed or extended with zeros the next power of 2.

24. The method of claim 22 wherein said data array is chosen to be length of said audio signal.

25. A computer readable medium with a computer program written in Visual Basic or another computer language, that decreases the time of the audio signal with no subsequent change in pitch by implementing the method in claim 13.

26. Hardware, such as chips or electrical circuits, that decreases the time of the audio signal with no subsequent change in pitch by implementing the method in claim 13.

27. The method according to claim 1, where, in step (C), the square root of the sum of the squares of the values of the sine and cosine Fourier coefficients is used to determine the signature instead of averaging the said sine and cosine Fourier coefficients.

28. The method according to claim 13, where, in step (C), the square root of the sum of the squares of the values of the sine and cosine Fourier coefficients is used to determine the signature instead of averaging the said sine and cosine Fourier coefficients.

29. The method according to claim 13, where, in step (D), the dominant frequency(ies) in the first chunk are compared with the dominant frequency(ies) in the next chunk and subsequent chunks, marking each chunk with dominant frequency(ies) substantially identical to the first chunk, until a comparison concludes that the dominant frequencies of the first chunk and chunk currently being compared to the first chunk are not substantially identical, at which point the next chunk is then, compared to subsequent chunks in the same manner as the chunk was compared to subsequent chunks, until the final chunk in the series is reached.

* * * * *